US009174752B2

(12) United States Patent
Neeser et al.

(10) Patent No.: US 9,174,752 B2
(45) Date of Patent: Nov. 3, 2015

(54) STRAPPING DEVICE WITH A GEAR SYSTEM DEVICE

(75) Inventors: Mirco Neeser, Ennetbaden (CH); Roland Widmer, Bremgarten (CH); Flavio Finzo, Wuerenlos (CH)

(73) Assignee: Signode Industrial Group LLC, Glenview, IL (US)

( * ) Notice: Subject to any disclaimer, the term of this patent is extended or adjusted under 35 U.S.C. 154(b) by 786 days.

(21) Appl. No.: 12/989,112

(22) PCT Filed: Jan. 6, 2009

(86) PCT No.: PCT/CH2009/000001

§ 371 (c)(1),
(2), (4) Date: Nov. 23, 2010

(87) PCT Pub. No.: WO2009/129633

PCT Pub. Date: Oct. 29, 2009

(65) Prior Publication Data

US 2011/0056389 A1 Mar. 10, 2011

(30) Foreign Application Priority Data

Apr. 23, 2008 (CH) ..... 645/08

(51) Int. Cl.
*B65B 13/24* (2006.01)
*B65B 13/32* (2006.01)
(Continued)

(52) U.S. Cl.
CPC ..... *B65B 13/322* (2013.01); *B65B 13/025* (2013.01); *B65B 13/187* (2013.01)

(58) Field of Classification Search
CPC .... B65B 13/025; B65B 13/322; B65B 13/187
USPC ..... 100/19, 32, 30, 33 R, 33 PB, 29
See application file for complete search history.

(56) References Cited

U.S. PATENT DOCUMENTS 3,367,374 A 2/1968 Meier et al.
3,654,033 A 4/1972 Angarola et al.
(Continued)

FOREIGN PATENT DOCUMENTS

CN 1253099 A 5/2000
CN 1558842 A 12/2004
(Continued)

OTHER PUBLICATIONS

ISR for PCT/CH2009/000001 mailed Jun. 22, 2009.
(Continued)

*Primary Examiner* — Jimmy T Nguyen
*Assistant Examiner* — Chwen-Wei Su
(74) *Attorney, Agent, or Firm* — Neal, Gerber & Eisenberg LLP

(57) ABSTRACT

A mobile strapping device for strapping packaged goods with wrap-around strap including a tensioner for applying a strap tension to a loop of a wrapping strap, and a friction welder for producing a friction weld connection by way of a friction welding element at two areas of the loop of the wrapping strap disposed one on top of the other, and a chargeable energy storage means for storing electrical energy that can be released as drive energy for motorized drive motions at least for the friction welder for producing a friction weld connection. For a strapping device with high functional reliability and ease of handling, despite the possibility of automated production of wrapped straps, at least to a large extent, the strapping device to includes a planetary gear system for transferring and changing the rotational speed of a drive motion provided by an electrical drive of the friction welder.

34 Claims, 9 Drawing Sheets

(51) Int. Cl.
*B65B 13/02* (2006.01)
*B65B 13/18* (2006.01)

(56) References Cited

U.S. PATENT DOCUMENTS

| | | | | |
|---|---|---|---|---|
| 4,011,807 | A * | 3/1977 | Kobiella | 100/2 |
| 4,015,643 | A | 4/1977 | Cheung | |
| 4,313,779 | A | 2/1982 | Nix | |
| 4,450,032 | A * | 5/1984 | Wehr | 156/353 |
| 4,572,064 | A | 2/1986 | Burton et al. | |
| 4,707,390 | A | 11/1987 | Cheung | |
| 4,776,905 | A | 10/1988 | Cheung et al. | |
| 5,133,532 | A | 7/1992 | Figiel et al. | |
| 5,146,847 | A | 9/1992 | Lyon et al. | |
| 5,155,982 | A * | 10/1992 | Boek et al. | 53/589 |
| 5,159,218 | A * | 10/1992 | Murry et al. | 310/68 B |
| 5,516,022 | A | 5/1996 | Annis, Jr. | |
| 5,689,943 | A | 11/1997 | Wehr | |
| 5,690,023 | A | 11/1997 | Stamm et al. | |
| 5,798,596 | A * | 8/1998 | Lordo | 310/216.016 |
| 5,809,873 | A | 9/1998 | Chak et al. | |
| 6,003,578 | A | 12/1999 | Chang | |
| 6,109,325 | A | 8/2000 | Chang | |
| 6,308,760 | B1 | 10/2001 | Finzo et al. | |
| 6,332,306 | B1 | 12/2001 | Finzo et al. | |
| 6,405,766 | B1 | 6/2002 | Benjey | |
| 6,516,715 | B1 | 2/2003 | Reiche | |
| 6,578,337 | B2 | 6/2003 | Scholl et al. | |
| 6,606,766 | B2 | 8/2003 | Ko | |
| 6,644,713 | B2 | 11/2003 | Del Pozo Abejon et al. | |
| 6,715,375 | B2 | 4/2004 | Nestler | |
| 6,732,638 | B1 | 5/2004 | Rometty et al. | |
| 6,817,159 | B2 | 11/2004 | Sakaki et al. | |
| 6,918,235 | B2 | 7/2005 | Nix | |
| 7,011,000 | B2 | 3/2006 | Kushida et al. | |
| 7,249,862 | B2 | 7/2007 | Shirane | |
| 7,312,609 | B2 | 12/2007 | Schmollngruber et al. | |
| 7,456,608 | B2 | 11/2008 | Kageler et al. | |
| 8,198,839 | B2 | 6/2012 | Katou et al. | |
| 8,378,600 | B2 | 2/2013 | Katou et al. | |
| 2002/0129717 | A1 | 9/2002 | Helland et al. | |
| 2003/0145900 | A1 | 8/2003 | Jensen et al. | |
| 2005/0279198 | A1 | 12/2005 | Kushida et al. | |
| 2006/0108180 | A1 | 5/2006 | Grach et al. | |
| 2006/0192527 | A1 | 8/2006 | Kageler et al. | |
| 2009/0013656 | A1 | 1/2009 | Nasiatka et al. | |

FOREIGN PATENT DOCUMENTS

| | | | |
|---|---|---|---|
| CN | 1859999 | | 11/2006 |
| CN | 201411061 | | 2/2010 |
| CN | 201411061 | Y | 2/2010 |
| DE | 19751861 | | 1/1999 |
| DE | 10026200 | | 11/2001 |
| DE | 10026200 | A1 | 11/2001 |
| DE | 20321137 | U1 | 1/2006 |
| EP | 0480627 | A1 | 4/1992 |
| EP | 0744343 | | 11/1996 |
| EP | 0949146 | A1 | 10/1999 |
| EP | 0997377 | A1 | 5/2000 |
| EP | 0999133 | | 5/2000 |
| EP | 1316506 | A1 | 6/2003 |
| EP | 1413519 | A1 * | 4/2004 |
| JP | S5290398 | A | 7/1977 |
| JP | S541238 | | 1/1979 |
| JP | S5638220 | A | 4/1981 |
| JP | S6322320 | A | 1/1988 |
| JP | H05198241 | | 8/1993 |
| JP | H07300108 | | 10/1996 |
| JP | H08324506 | A | 12/1996 |
| JP | H09283103 | A | 10/1997 |
| JP | 3044132 | | 5/2000 |
| JP | 2000128113 | A | 5/2000 |
| JP | 2000128115 | A | 5/2000 |
| JP | 3227693 | | 11/2001 |
| JP | 3242081 | | 12/2001 |
| JP | 2002235830 | A | 8/2002 |
| JP | 2003170906 | | 6/2003 |
| JP | 2003231291 | A | 8/2003 |
| JP | 2003348899 | A | 12/2003 |
| JP | 2004108593 | | 4/2004 |
| JP | 3548622 | | 7/2004 |
| JP | 2004241150 | | 8/2004 |
| JP | 2004323111 | | 11/2004 |
| JP | 2007276042 | A | 10/2007 |
| JP | 4406016 | | 1/2010 |
| KR | 840002211 | | 12/1984 |
| KR | 20000029337 | | 5/2000 |
| RU | 1772784 | C | 10/1992 |
| RU | 2118277 | C1 | 8/1998 |
| RU | 2161773 | | 1/2001 |
| RU | 2004115639 | A | 1/2006 |
| RU | 2355281 | | 5/2009 |
| SU | 1134117 | | 1/1985 |
| WO | 2006048738 | A1 | 5/2006 |
| WO | WO 2007/116914 | | 10/2007 |
| WO | WO 2009/129633 | | 10/2009 |
| WO | WO 2009/129636 | | 10/2009 |

OTHER PUBLICATIONS

Brushless DC Motor Drives, by Ali Emandi, in Energy-Efficient Electrical Motors, 3rd ed., Aug. 2004, ¶. 270-272, CRC Press & Marcel Dekker.

Lithium ion technology: shaping power tool. By Bender, in Air conditioning, heating, and refrigeration news. vol. 228, Issue 14, p. 18 Jul. 31, 2006.

Korean Office Action dated May 18, 2015 for Korean Application No. 10-2010-7023709 (7 pages).

* cited by examiner

STRAPPING DEVICE WITH A GEAR SYSTEM DEVICE

RELATED APPLICATIONS

The present application is national phase of International Application Number PCT/CH2009/000001 filed Jan. 6, 2009, and claims priority from, Swiss Application Number 645/08 filed Apr. 23, 2008.

The invention relates to a mobile strapping device for strapping packaged goods with a wrap-around strap, comprising a tensioner for applying a strap tension to a loop of a wrapping strap, as well as a friction welder for producing a friction weld at two areas of the loop of wrapping strap disposed one on top of the other, and a chargeable energy storage means for storing energy that can be released as drive energy at least for the friction welder for producing a friction weld.

Such mobile strapping devices are used for strapping packaged goods with a plastic strap. For this a loop of the plastic strap is placed around the packaged goods. Generally the plastic strap is obtained from a storage roll. After the loop has been completely placed around the packaged goods, the end area of the strap overlaps a section of the strap loop. The strapping device is then applied at this dual-layer area of the strap, the strap clamped into the strapping device, a strap tension applied to the strap loop by the strapping device and a seal produced on the loop between the two strap layers by the friction welding. Here a friction shoe moving in an oscillating manner is pressed onto the area of two ends of the strap loop. The pressure and the heat produced by the movement briefly locally melt the strap which generally contains a plastic. This produces a durable connection between the two strap layers which can only be broken with a large amount of force. The loop is then separated from the storage roll. The packaged goods are thus strapped.

Strapping devices of this type are intended for mobile use, whereby the devices are taken by a user to the location of use and are not reliant on the provision of external supply energy. The energy required for the envisaged use of such strapping device to strap a wrapping strap around any packaged goods and to produce the seal, is general provided in previously known strapping device by an electrical storage battery or by compressed air. Strapping devices of this type are often in continuous use in industry for packaging goods. Therefore as simple operation of the strapping devices as possible is aimed for. In this way on the one hand a high level of functional reliability, associated with high-quality strapping, and on the other hand as little effort as possible for the operator should be assured Strapping devices have already become known in which production of the seal and production of the strap tension are largely automated. However, automation of the processes has the disadvantage that the strapping devices have a large number of components and generally also several motors. This results in heavy and voluminous strapping devices. Also, strapping devices provided with a large number of components tend to top heavy in terms of their weigh distribution. Finally automation also had disadvantages in terms of maintenance costs and the functional reliability of such strapping devices.

The aim of the invention is therefore to create a mobile strapping device of the type set out in the introductory section, which in spite of the possibility of at least largely automated production of wrapped straps, exhibits a high level of functional reliability and good handling properties.

In accordance with the invention this objective is achieved with a mobile strapping device in accordance with the introductory section of claim 1 by means of a planetary gear system for transferring and changing the rotational speed of a drive movement provided by an electrical drive of the friction welder. In accordance with the invention the strapping device has at least one planetary gear system which is arranged in the drive train of the friction welder. It has been shown planetary gear in combination with an electrical drive motor provide particularly advantages in friction welders. For example, with planetary gears, in spite of high initial speeds and compact design, high torques can be produced.

This can also be advantageously used for the particularly functionally reliable, possibly automated transfer movement of the friction welder from a rest position into a welding position, in which the friction welder is in contact with the strap to be welded and produces a friction weld by way of an oscillating motion. This can be of particular advantage if, as is the case in particularly advantageous embodiments of the invention, both the actual friction welding movement of a friction welding element as well as the transfer movement can be generated by the same drive. Such an embodiment with only one drive for these functions is, despite the high degree of automation, particularly compact, and, with its weight being advantageously distributed, nevertheless functionally reliable.

These advantages can be improved further by way of forms of embodiment in accordance with the invention in which the same drive, designed to bring about the oscillating friction welding motion, also generators the tensioning movement of the strapping device. In order to be able to make the strapping device as compact as possible despite the high torque, a planetary gear system can also be arranged in the drive train of the strapping device.

In accordance with a further aspect of the present invention, which is also of independent relevance, the strapping device is provided with a brushless direct current motor. More particularly, this motor can be envisaged as the sole motor in the strapping device. Unlike in the case of brush-based direct current motors, such a motor can over a broad speed range produce a rotational movement with an essentially constant and comparatively high torque. Such a high torque is advantageous more particularly for motor-driven transfer movements of the friction welder from a rest position into a welding position and possibly back again. If high torques can be provided by the strapping device, it is possible to make the start of the transfer movement dependent on overcoming high forces. This increases the reliability, more particularly the functional reliability, as the fiction welder cannot be accidentally moved from its envisaged position by external influences.

By using a brushless direct current motor as the drive for the tensioner, further advantages can be achieved, as in this way it is possible to control the rotational speed of the tensioning procedure. For example, in contrast to hitherto possible torques, even a low speeds this allows a comparatively high tensioning device torque. Thus, with such mobile strapping device it is for the first time possible to place a strap around packaged goods at low speed but towards the end of the tensioning procedure. In previous tensioners, in order to achieve sufficient strap tensioning, the strap had to be moved at high speed at the start of the tensioning procedure, so that the required strap tension can be achieved towards the end of the tensioning procedure. In doing so the strap is whipped against the packaged goods which involves a high risk of damaging the packaged goods. Even sensitive packaged goods can thus be strapped all-round with considerably less danger of damage.

Furthermore, a speed-dependent/speed-controlled tensioning procedure also allows rapid initial tensioning, i.e. tensioning at high strap retraction speed, followed by second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

In accordance with a further aspect of the present invention, which may also be independently relevant, the strapping device is provided with means with which the rotation position of the motor shaft or the positions of components of the strapping device dependent on the motor shaft can be determined. The information about one or more rotational positions can preferably be used by a strapping device controller to control components of the strapping device, such as the friction welder and/or the tensioner. If a brushless direct current motor is used as the device, this can be done in a particularly simple way. For their commutation such motors must already determine information about momentary positions of the rotating component of the motor, which is generally designed as rotating anchor. For this, detectors/sensors, such as Hall sensors, are provided on the motor which determine the rotational positions of the rotating motor components and make them available to the motor control unit. This information can also advantageously be used to control the friction welder.

Thus, in a preferred embodiment of the strapping device it can be envisaged that a number of rotations of the rotating components of the motor are determined in order, on reaching a given value or rotations, to carry out a switching operation. More particularly, this switching operation can involve switching off the friction welder to terminate the production of a friction weld connection. In a further advantageous embodiment of the invention it can be envisaged that at one or at several determined rotational positions the motor is not switched off, or is only switched off at one or more determined rotation positions.

Finally it has proven to be advantageous if a device with a toggle lever system is provided to move the welding device from the rest position into the welding position and back. The levers of the toggle lever joint, which are connected to each other via one joint, can, by overcoming two dead point positions, be brought into both end positions at which they hold the welding device in the rest position or in the welding position. Advantageously the toggle lever device is held in both end positions by a force, preferably a force exerted by a mechanical spring. Only by overcoming this force should the toggle lever device be able to move from one end position into the other. The toggle lever device achieves the advantage that end positions of the welding device are only changed by overcoming comparatively high torques. As this applies especially to the welding position, the toggle lever system contributes to further increasing the functional reliability of the strapping device. Furthermore, the toggle lever system advantageously supplements the drive train of the strapping device, which in one form of embodiment of the invention also has a brushless motor and a planetary gear system in addition to the toggle lever system, for automated movement of the welding device into its welding position, as all the components are able to produce high torques or carry out movements when high torques are applied.

Further preferred embodiments of the invention are set out in the claims, the description and the drawing.

The invention will be described in more detail by way of the examples of embodiment which are shown purely schematically.

Figure 1:
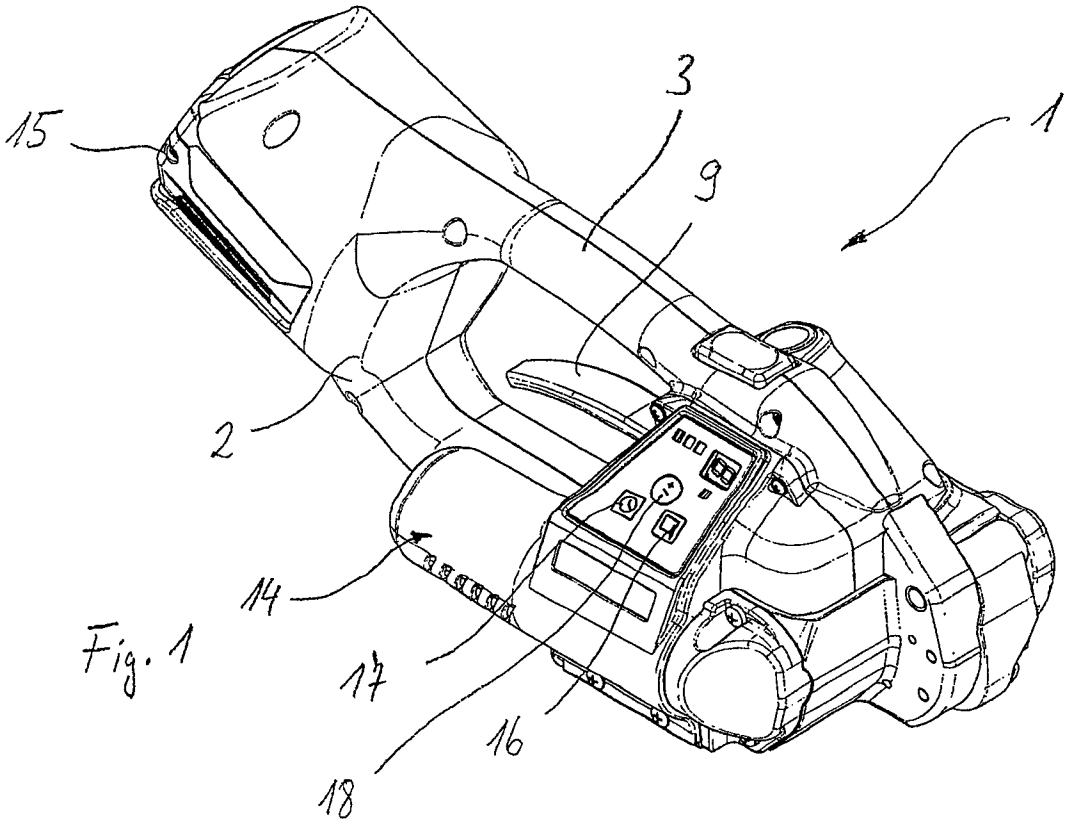
FIG. 1 is a perspective view of a strapping device in accordance with the invention.
Figure 2:
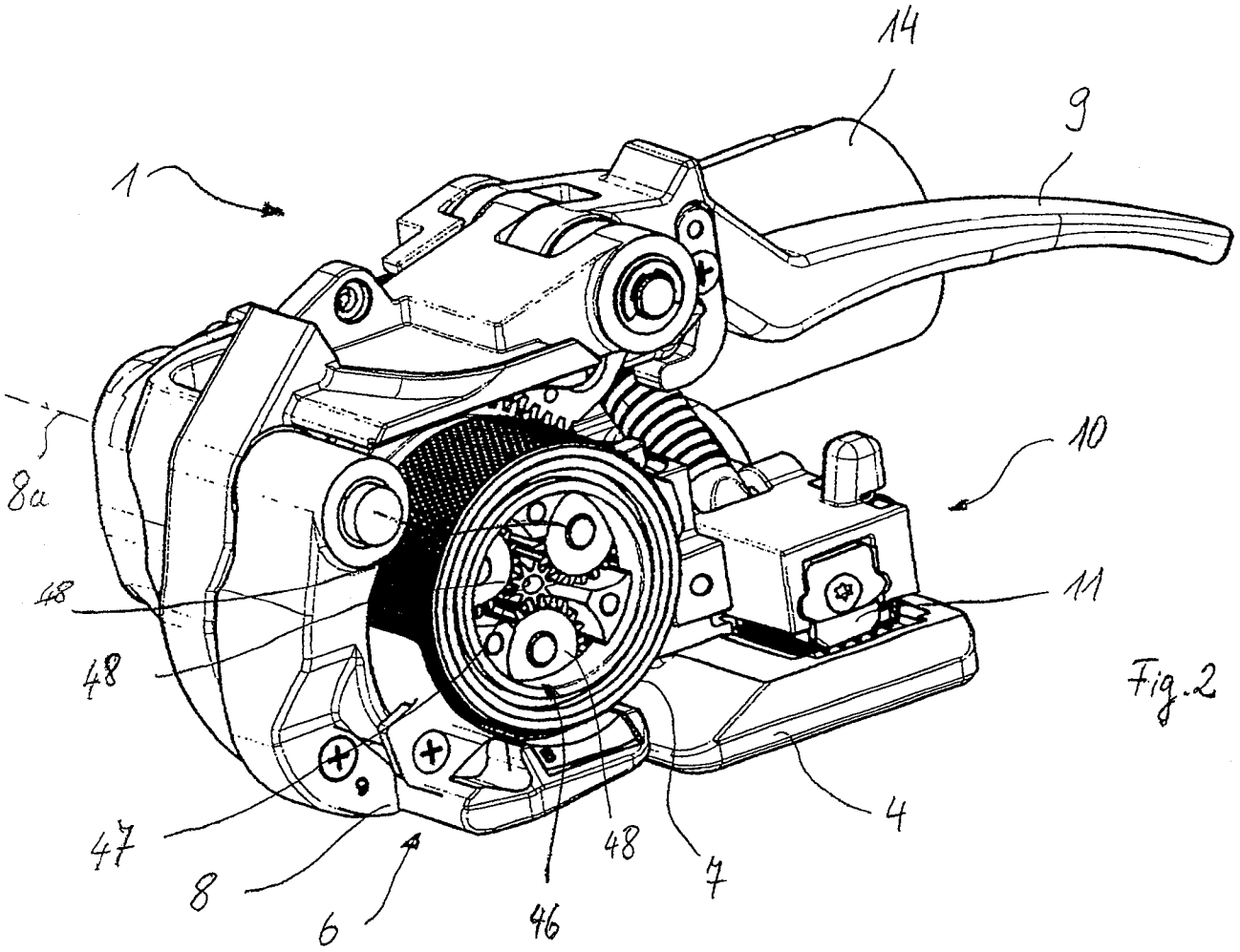
FIG. 2 shows the strapping device in FIG. 1 with the casing.
Figure 10:
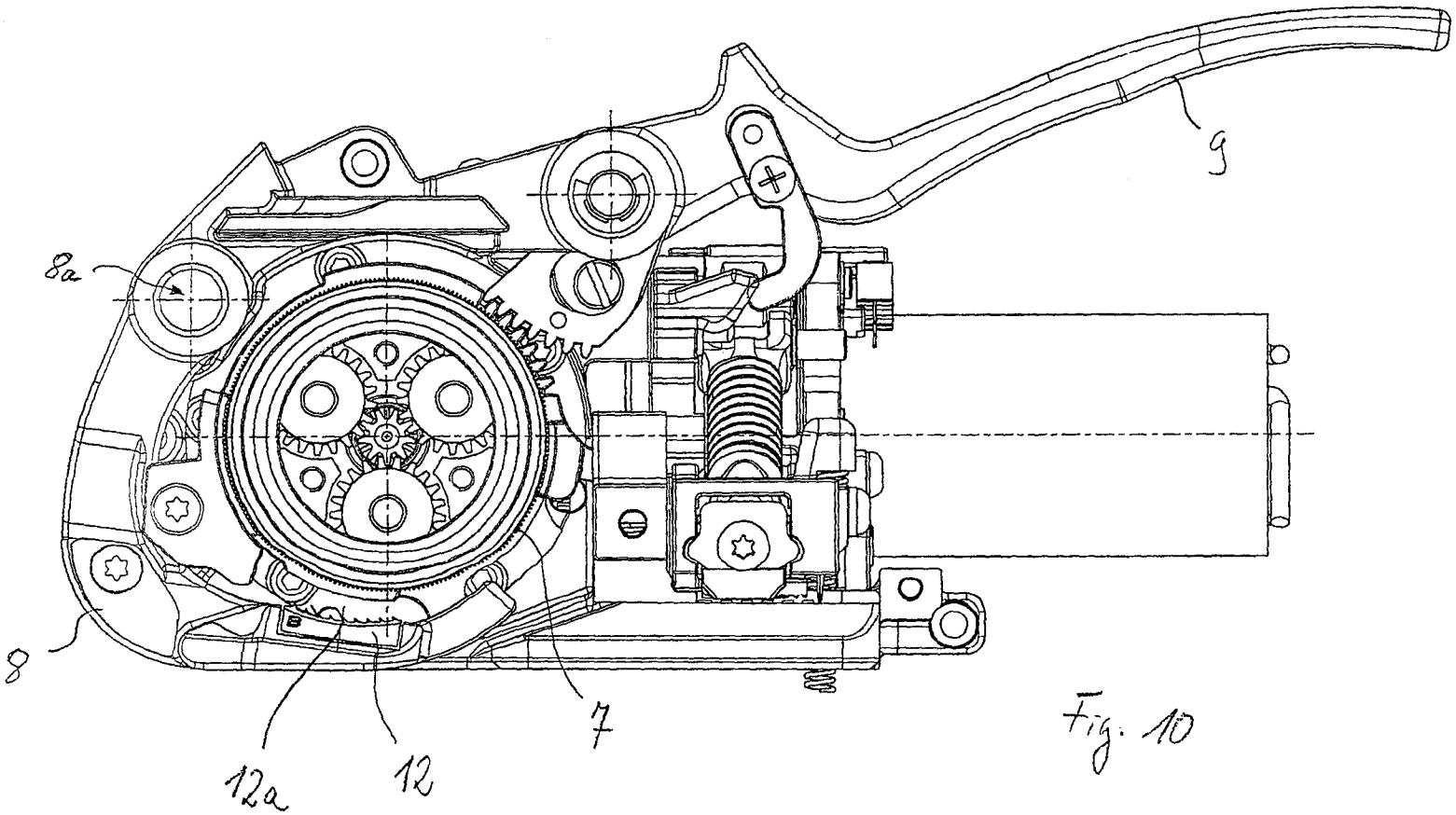
FIG. 10 shows a side view of the tensioner of the strapping device without the casing, in which a tensioning rocker is in a rest position.
Figure 13:
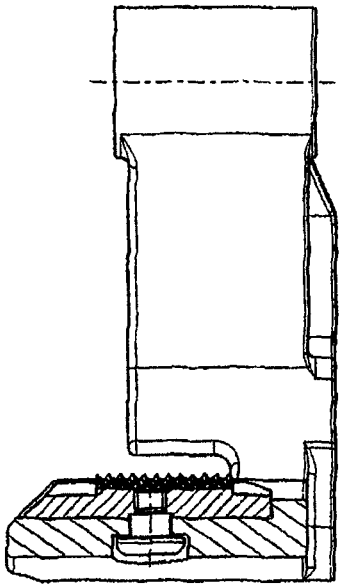
Figure 12:
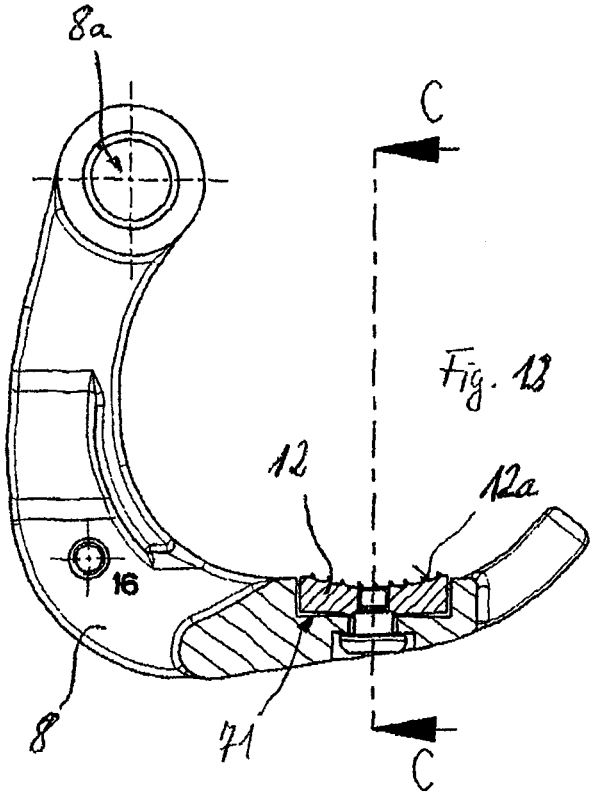
Figure 14:
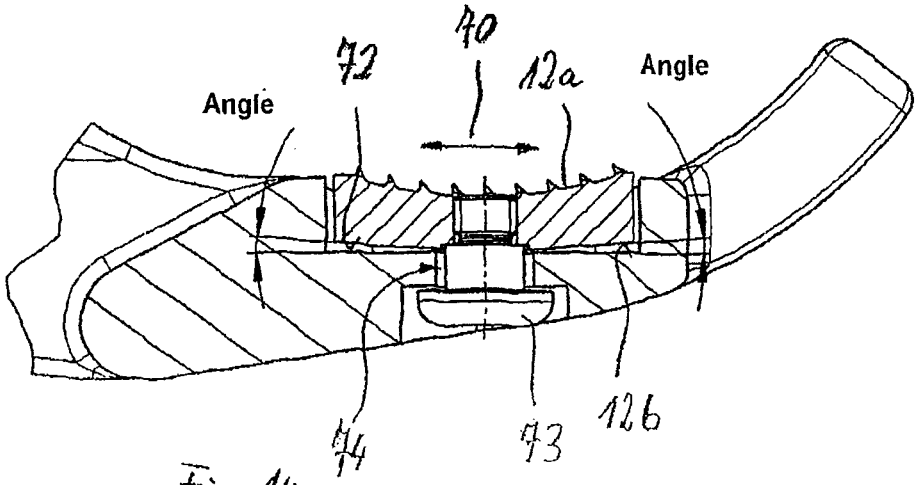

FIG. 12 a side view of the tensioning rocker of the strapping device in FIG. 10 shown in a partial section;

FIG. 13 shows a front view of the tensioning rocker in FIG. 12;

FIG. 14 shows a detail from FIG. 12 along line C-C;

The exclusively manually operated strapping device 1 in accordance with the invention shown in FIGS. 1 and 2 has a casing 2, surrounding the mechanical system of the strapping device, on which a grip 3 for handling the device is arranged. The strapping device also has a base plate 4, the underside of which is intended for placing on an object to be packed. All the functional units of the strapping device 1 are attached on the base place 4 and on the carrier of the strapping device which is connected to the base plate and is not shown in further detail.

With the strapping device 1 a loop of plastic strap, made for example of polypropylene (PP) or polyester (PET), which is not shown in more detail in FIG. 1 and which has previously been placed around the object to be packed, can be tensioned with a tensioner 6 of the strapping device. For this the tensioner has a tensioning wheel 7 with which the strap can be held for a tensioning procedure. The tensioning wheel 7 operates in conjunction with a rocker 8, which by means of a rocker lever 9 can be pivoted from an end position at a distance from the tensioning wheel into a second end position about a rocker pivoting axis 8*a*, in which the rocker 8 is pressed against the tensioning wheel 7. The strap located between the tensioning wheel 7 and the rocker 8 is also pressed against the tensioning wheel 7. By rotating the tensioning wheel 7 it is then possible to provide the strap loop with a strap tension that is high enough for the purpose of packing. The tensioning procedure, and the rocker 8 advantageously designed for this, is described in more detail below.

Subsequently, at a point on the strap loop on which two layers of the wrapping strap are disposed one on top of the other, welding of the two layers can take place by means of the friction welder 8 of the strapping device. In this way the strap loop can be durably connected. For this the friction welder 10 is provided with a welding shoe 11, which through mechanical pressure on the wrapping strap and simultaneous oscillating movement at a predefined frequencies starts to melt the two layers of the wrapping strap. The plastified or melted areas flow into each other and after cooling of the strap a connection is formed between the two strap layers. If necessary the strap loop can be separated from a strap storage roll by means of a strapping device 1 cutter which is not shown.

Operation of the tensioner 6, assignment of the friction welder 10 by means of a transfer device 19 (FIG. 6) of the friction welder as well as the operation of the friction welder itself and operation of the cutter all take place using only one common electric motor 14, which provides a drive movement for each of these components. For its power supply, an interchangeable storage battery 15, which can be removed for charging, is arranged on the strapping device. The supply of other external auxiliary energies, such as compressed air or additional electricity, is not envisaged in accordance with FIGS. 1 and 2.

The portable mobile strapping device 1 has an operating element 16, in the form of a press switch, which is intended for starting up the motor. Via a switch 17, three operating modes can be set for the operating element 16. In the first mode by operating the operating element 16, without further action being required by the operator, the tensioner 6 and the friction welder 10 are started up consecutively and automatically. To set the second mode the switch 17 is switched over to a second switching mode. In the second possible operating mode, by operating the operating element 15, only the tensioner 6 is started up. To separately start the friction welder 10 a second operating element 18 must be activated by the operator. In alternative forms of embodiment it can also be envisaged that in this mode the first operating element 16 has to be operated twice in order to activate the friction welder. The third mode is a type of semi-automatic operation in which the tensioning button 16 must be pressed until the tension force/tensile force which can preset in stages is achieved in the strap. In this mode it is possible to interrupt the tensioning process by releasing the tensioning button 16, for example in order to position edge protectors on the goods to be strapped under the wrapping strap. By pressing the tensioning button the tensioning procedure can then be continued. This third mode can be combined with a separately operated as well as an automatic subsequent friction welding procedure.

Figure 3:
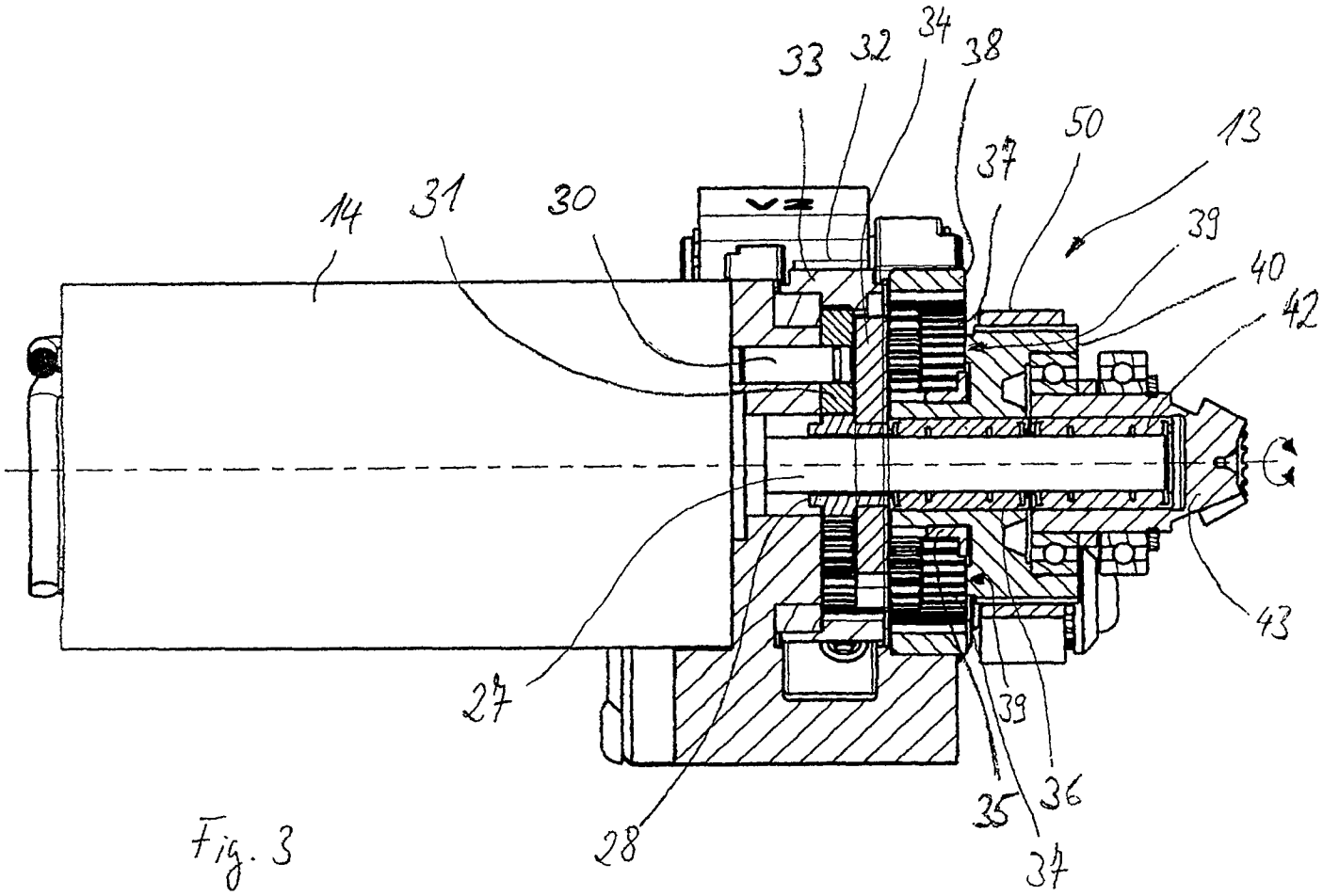
FIG. 3 shows a partial section view of the motor of the strapping device in FIG. 1, together with components arranged on the motor shaft.

On a motor shaft 27, shown in FIG. 3, of the brushless, grooved rotor direct current motor 14 a gearing system device 13 is arranged. In the example of embodiment shown here a type EC140 motor manufactured by Maxon Motor AG, Brünigstrasse 20, 6072 Sachseln is used. The brushless direct current motor 14 can be operated in both rotational directions, whereby one direction is used as the drive movement of the tensioner 6 and the other direction as the drive movement of the welding device 10.

Figure 4:
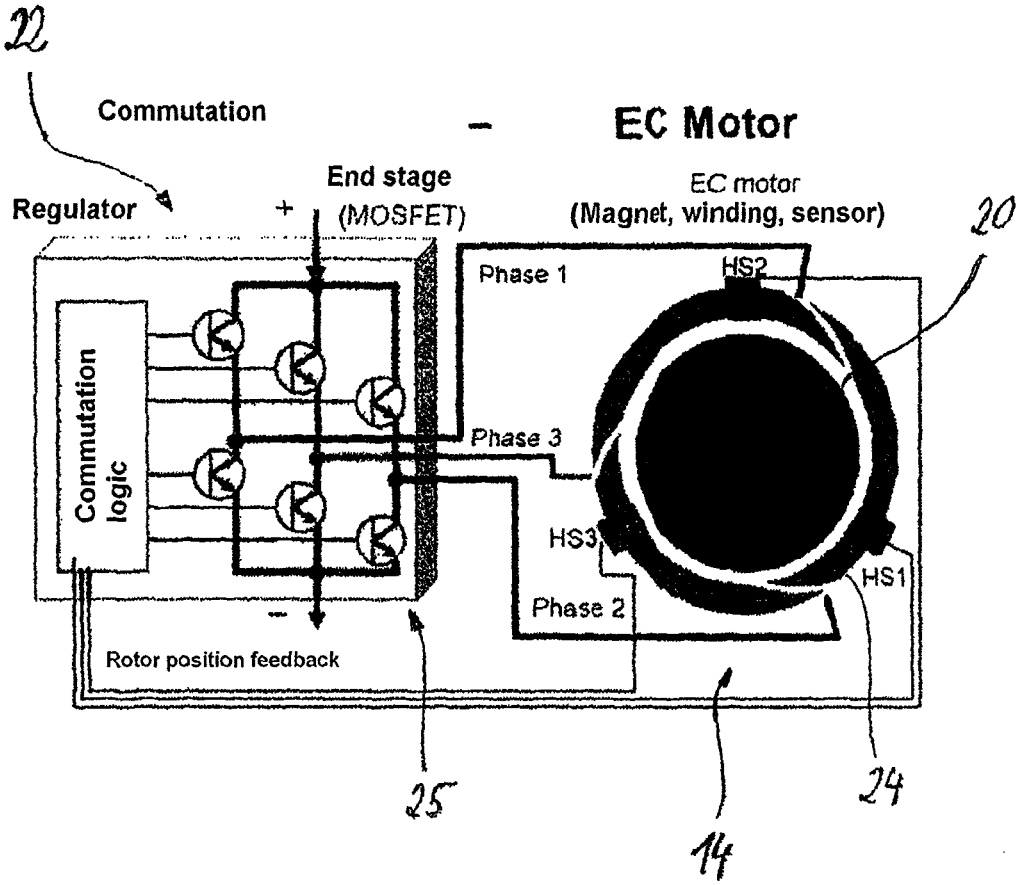
FIG. 4 shows a very schematic view of the motor along with its electronic commutation switch.

The brushless direct current motor 14, shown purely schematically in FIG. 4, is designed with a grooved rotor 20 with three Hall sensors HS1, HS2, HS3. In its rotor 20, this EC motor (electronically commutated motor) has a permanent magnet and is provided with an electronic control 22 intended for electronic commutation in the stator 24. Via the Hall sensors, HS1, HS2, HS3, which in the example of embodiment also assume the function of position sensors, the electronic control 22 determines the current position of the rotor and controls the electrical magnetic field in the windings of the stator 24. The phases (phase 1, phase 2, phase 3) can thus be controlled depending in the position of the rotor 20, in order to bring about a rotational movement of the rotor in a particular rotational direction with a predeterminable variable rotational speed and torque. In this present case a "1$^{st}$ quadrant motor drive intensifier" is used, which provides the motor with the voltage as well as peak and continuous current and regulates these. The current flow for coil windings of the stator 24, which are not shown in more detail, is controlled via a bridge circuit 25 (MOSFET transistors), i.e. commutated. A temperature sensor, which is not shown in more detail, is also provided on the motor. In this way the rotational direction, rotational speed, current limitation and temperature can be monitored and controlled. The commutator is designed as a separate print component and is accommodated in the strapping device separately from the motor.

The power supply is provided by the lithium-ion storage battery 15. Such storage batteries are based on several independent lithium ion cells in each of which essentially separate chemical processes take place to generate a potential difference between the two poles of each cell. In the example of embodiment the lithium ion storage battery is manufactured by Robert Bosch GmbH, D-70745 Leinfelden-Echterdingen. The battery in the example of embodiment has eight cells and has a capacity of 2.6 ampere-hours. Graphite is used as the active material/negative electrode of the lithium ion storage battery. The positive electrode often has lithium metal oxides, more particularly in the form of layered structures. Anhydrous salts, such as lithium hexafluorophosphate or polymers are usually used as the electrolyte. The voltage emitted by a conventional lithium ion storage battery is usually 3.6 volts. The energy density of such storage batteries is around 100 Wh/kh-120 Wh/kg.

On the motor side drive shaft, the gearing system device 13 has a free wheel 36, on which a sun gear 35 of a first planetary gear stage is arranged. The free wheel 36 only transfers the rotational movement to the sun gear 35 in one of the two possible rotational directions of the drive. The sun gear 35 meshes with three planetary gears 37 which in a known manner engage with a fixed gear 38. Each of the planetary gears 37 is arranged on a shaft 39 assigned to it, each of which is connected in one piece with an output gear 40. The rotation of the planetary gears 37 around the motor shaft 27 produces a rotational movement of the output gear 40 around the motor shaft 27 and determines a rotational speed of this rotational movement of the output gear 40. In addition to the sun gear 35 the output gear 40 is also on the free wheel 36 and is therefore also arranged on the motor shaft. This free wheel 36 ensures that both the sun gear 35 and the output gear 40 only also rotate in one rotational direction of the rotational movement of the motor shaft 27. The free wheel 29 can for example be of type INA HFL0615 as supplied by the company Schaeffler KG, D-91074 Herzogenaurach, On the motor-side output shaft 27 the gear system device 13 also has a toothed sun gear 28 belonging to a second planetary gear stage, through the recess of which the shaft 27 passes, though the shaft 27 is not connected to the sun gear 28. The sun gear is attached to a disk 34, which in turn is connected to the planetary gears. The rotational movement of the planetary gears 37 about the motor-side output shaft 27 is thus transferred to the disk 34, which in turn transfers its rotational movement at the same speed to the sun gear 28. With several planetary gears, namely three, the sun gear 28 meshes with cog gears 31 arranged on a shaft 30 running parallel to the motor shaft 27. The shafts 30 of the three cog gears 31 are fixed, i.e. they do not rotate about the motor shaft 27. In turn the cog gears 21 engage with an internal-tooth sprocket, which on its outer side has a cam 32 and is hereinafter referred to as the cam wheel 33. The sun gear 28, the three cog gears 31 as well as the cam wheel 33 are components of the second planetary gear stage. In the planetary gear system the inputside rotational movement of the shaft 27 and the rotational movement of the cam wheel are at a ratio of 60:1, i.e. a 60-fold reduction takes place through the second-stage planetary gear system.

At the end of the motor shaft 27, on a second free wheel 42 a bevel gear 43 is arranged, which engages in a second bevel gear, which is not shown in more detail. This free wheel 42 also only transmits the rotational movement in one rotational direction of the motor shaft 27. The rotational direction in which the free wheel 36 of the sun gear 35 and the free wheel 42 transmit the rotational movement of the motor shaft 27 is opposite. This means that in one rotational direction only free wheel 36 turns, and in the other rotational direction only free wheel 42.

The second bevel gear is arranged on one of a, not shown, tensioning shaft, which at its other end carries a further planetary gear system 46 (FIG. 2). The drive movement of the electric motor in a particular rotational direction is thus transmitted by the two bevel gears to the tensioning shaft. Via a sun gear 47 as well as three planetary gears 48 the tensioning wheel 49, in the form of an internally toothed sprocket, of the tensioner 6 is rotated. During rotation the tensioning wheel 7, provided with a surface structure on its outer surface, moves the wrapping strap through friction, as a result of which the strap loop is provided with the envisaged tension.

Figure 5:
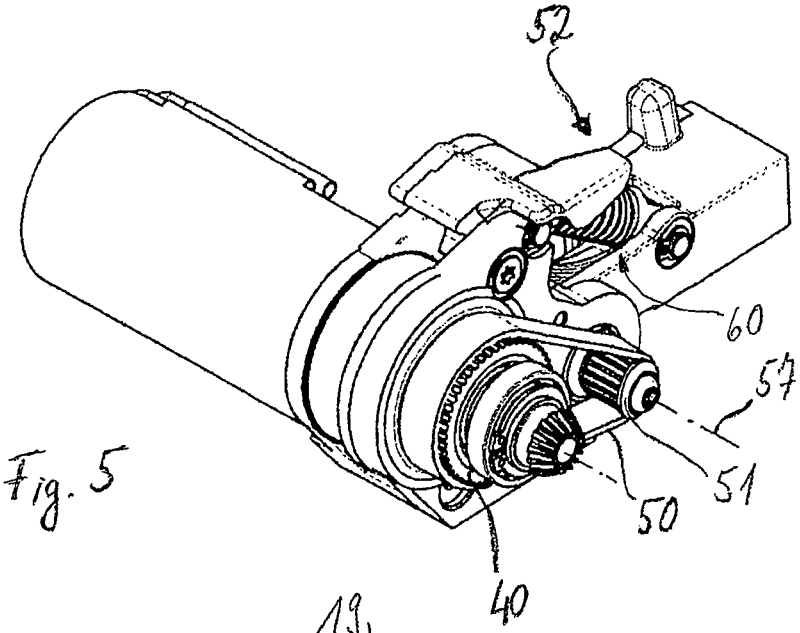
FIG. 5 shows a perspective partial view of the drive train of the strapping device in FIG. 1.
Figure 6:
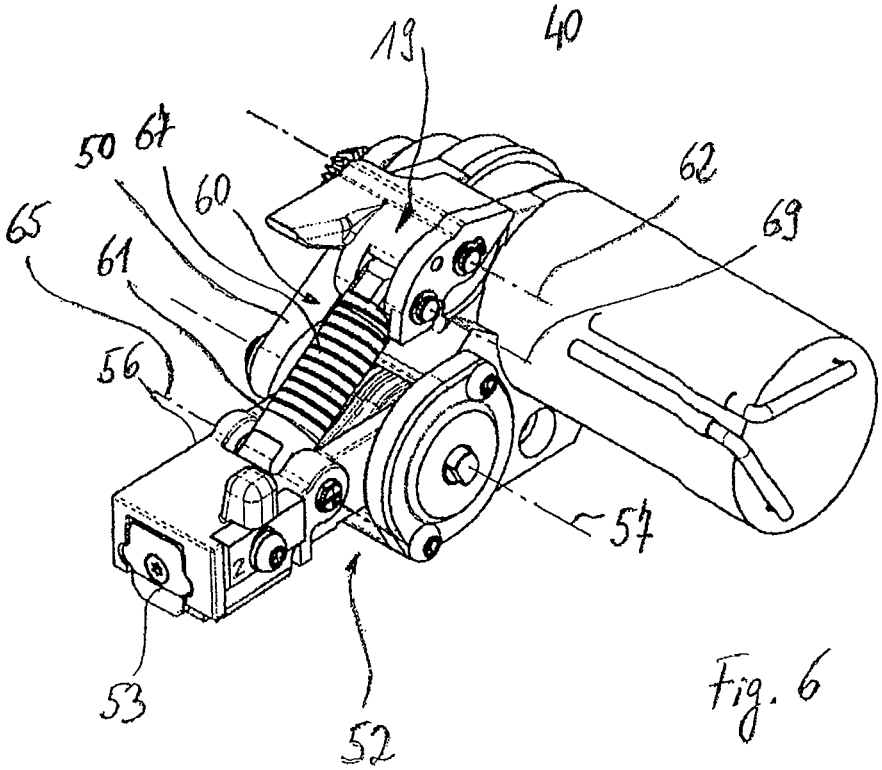
FIG. 6 shows the drive train in FIG. 5 from another direction of view.

In the area of its outer circumference the output gear 40 is designed as a cog gear on which is a toothed belt of an envelope drive (FIGS. 5 and 6). The toothed belt 50 also goes round pinion 51, smaller in diameter than the output gear 40, the shaft of which drive an eccentric drive 52 for producing an oscillating to and fro movement of the welding shoe 53. Instead of toothed belt drive any other form of envelope drive could be provided, such as a V-belt or chain drive. The eccentric drive 52 has an eccentric shaft 54 on which an eccentric tappet 55 is arranged on which in turn a welding shoe arm 56 with a circular recess is mounted. The eccentric rotational movement of the eccentric tappet 55 about the rotational axis 57 of the eccentric shaft 54 results in a translator oscillating to and fro movement of the welding shoe 53. Both the eccentric drive 52 as well as the welding shoe 53 it can be designed in any other previously known manner.

Figure 9:
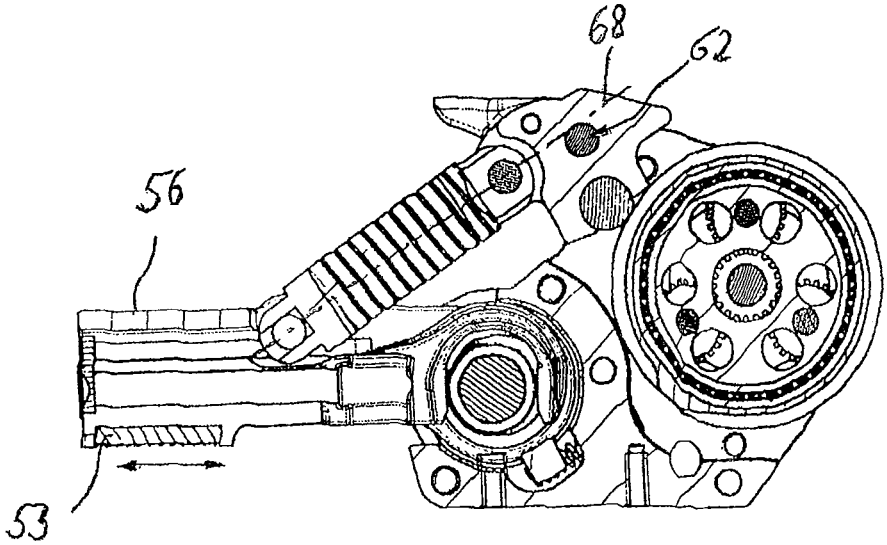
FIG. 9 shows a side view of the drive train in FIG. 5 with the welding device in a welding position.

The welding device is also provided with a toggle lever device 60, by means of which the welding device can be moved from a rest position (FIG. 7) into a welding position (FIG. 9). The toggle lever device 60 is attached to the welding shoe arm 56 and provided with a longer toggle lever 61 privotably articulated on the welding shoe arm 56. The toggle lever device 60 is also provided with a pivoting element 63, pivotably articulated about a pivoting axis 62, which in the toggle level device 60 acts as the shorter toggle lever. The pivoting axis 62 of the pivoting element 63 runs parallel to the axes of the motor shaft 27 and the eccentric shaft 57.

Figure 7:
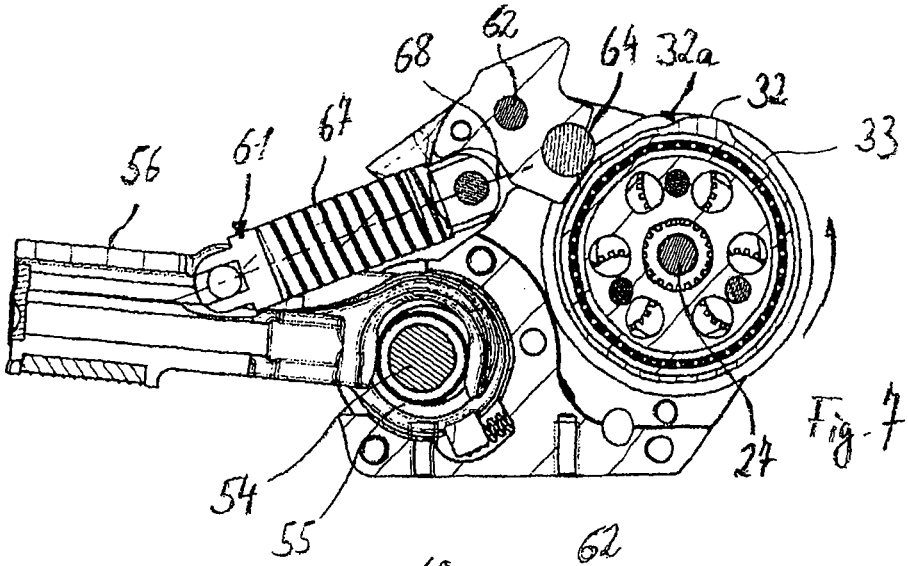
FIG. 7 shows a side view of the drive train in FIG. 5 with the welding device in the rest position.
Figure 8:
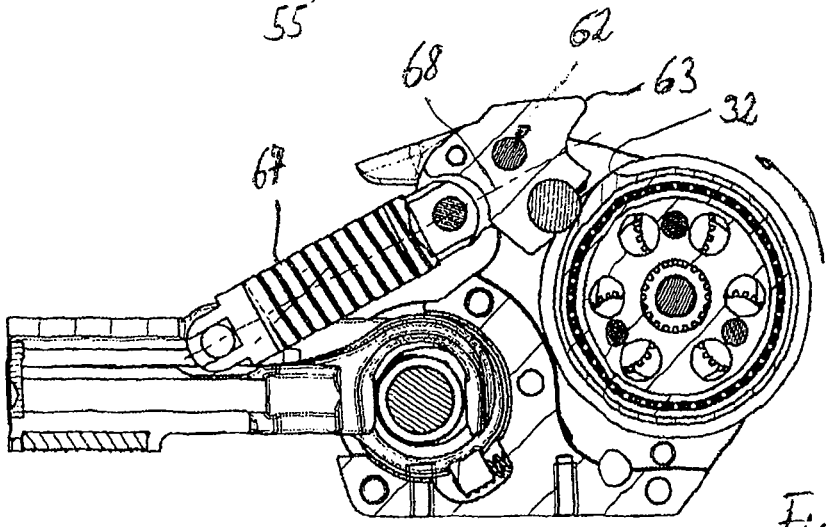
FIG. 8 shows a side view of the drive train in FIG. 6 with the welding device in a position between two end positions.

The pivoting movement is initiated by the cam 32 on the cam wheel 33 which during rotational movement in the anticlockwise direction—in relation to the depictions in FIGS. 7 to 9—of the cam wheel 33 ends up under the pivoting element 63 (FIG. 8). A ramp-like ascending surface 32*a* of the cam 32 comes into contact with a contact element 64 set into the pivoting element 63. The pivoting element 63 is thus rotated clockwise about its pivoting axis 62. In the area of a concave recess of the pivoting element 63 a two-part longitudinally-adjustable toggle lever rod of the toggle lever 61 is pivotably arranged about a pivoting axis 69 in accordance with the 'piston cylinder' principle. The latter is also rotatably articulated on an articulation point 65, designed as a further pivoting axis 65, of the welding shoe arm 56 in the vicinity of the welding shoe 53 and at a distance from the pivoting axis 57 of the welding shoe arm 56. Between both ends of the longitudinally adjustable toggle lever rod a pressure spring 67 is arranged thereon, by means of which the toggle lever 61 is pressed against both the welding shoe arm 56 as well as against the pivoting element 63. In terms of its pivoting movements the pivoting element 63 is thus functionally connected to the toggle lever 61 and the welding shoe arm 56.

As can be seen in the depictions in FIG. 7, in the rest position there is an (imaginary) connecting line 68 for both articulation points of the toggle lever 61 running through the toggle lever 61 between the pivoting axis 62 of the pivoting element 63 and the cam wheel 33, i.e. on one side of the pivoting axis 62. By operating the cam wheel 33 the pivoting element 63 is rotated clockwise—in relation to the depictions in FIGS. 7 to 9. In this way the toggle lever 61 of the pivoting 63 is also operated. In FIG. 8 an intermediate position of the toggle lever 61 is shown in which the connecting line 68 of the articulation points 65, 69 intersects the pivoting axis 62 of the pivoting element 63. In the end position of the movement (welding position) shown in FIG. 9 the toggle lever 61 with its connecting line 68 is then on the other side of the pivoting axis 62 of the pivoting element 63 in relation to the cam wheel 33 and the rest position. During this movement the welding arm shoe 56 is transferred by the toggle lever 61 from its rest position into the welding position by rotation about the pivoting axis 57. In the latter position the pressure spring 67 presses the pivoting element 63 against a stop, not shown in further detail, and the welding shoe 53 onto the two strap layers to be welded together. The toggle lever 61, and therefore also the welding shoe arm 56, is thus in a stable welding position.

The anticlockwise drive movement of the electric motor shown in FIGS. 6 and 9 is transmitted by the toothed belt 50 to the welding shoe 53, brought into the welding position by the toggle lever device 60, which is pressed onto both strap layer and moved to and fro in an oscillating movement. The welding time for producing a friction weld connection is determined by way of the adjustable number of revolutions of the cam wheel 33 being counted as of the time at which the cam 32 operates the contact element 64. For this the number of revolutions of the shaft 27 of the brushless direct current motor 14 is counted in order to determine the position of the cam wheel 33 as of which the motor 14 should switch off and thereby end the welding procedure. It should be avoided that on switching off the motor 14 the cam 32 comes to a rest under the contact element 64. Therefore, for switching off the motor 14 only relative positions of the cam 32 with regard to the pivoting element 63 are envisaged, a which the cam 32 is not under the pivoting element. This ensures that the welding shoe arm 56 can pivot back from the welding position into the rest position (FIG. 7). More particularly, this avoids a position of the cam 32 at which the cam 32 would position the toggle lever 61 at a dead point, i.e. a position in which the connecting line 68 of the two articulation points intersects the pivoting axis 62 of the pivoting element 63—as shown in FIG. 8. As such a position is avoided, by means of operating the rocker lever the rocker (FIG. 2) can be released from the tensioning wheel 7 and the toggle lever 61 pivoted in the direction of the cam wheel 33 into the position shown in FIG. 7. After the strap loop has been taken out of the strapping device, the latter is ready for a further strapping procedure.

The described consecutive procedures "tensioning" and "welding" can be jointly initiated in one switching status of the operating element 15. For this the operating element 16 is operated once, whereby the electric motor 14 first turns on the first rotational direction and thereby (only) the tensioner 6 is driven. The strap tension to be applied to the strap can be set on the strapping device, preferably be means of a push button in nine stages, which correspond to nine different strap tensions. Alternatively continuous adjustment of the strap tension can be envisaged. As the motor current is dependent on the torque of the tensioning wheel 7, and this in turn on the current strap tension, the strap tension to be applied can be set via push buttons in nine stages in the form of a motor current limit value on the control electronics of the strapping device.

After reaching a settable and thus predeterminable limit value for the motor current/strap tension, the motor 14 is switched off by its control device 22. Immediately afterwards the control device 22 operates the motor in the opposite rotational direction. As a result, in the manner described above, the welding shoe 52 is lowered onto the two layers of strap displaced one on top of the other and the oscillating movement of the welding shoe is carried out to produce the friction weld connection.

By operating switch 17 the operating element 16 can only activate the tensioner. If this is set, by operating the operating element only the tensioner is brought into operation and on reaching the preset strap tension is switched off again. To start the friction welding procedure the second operating element 18 must be operated. However, apart from separate activation, the function of the friction welding device is identical the other mode of the first operating element.

Figure 11:
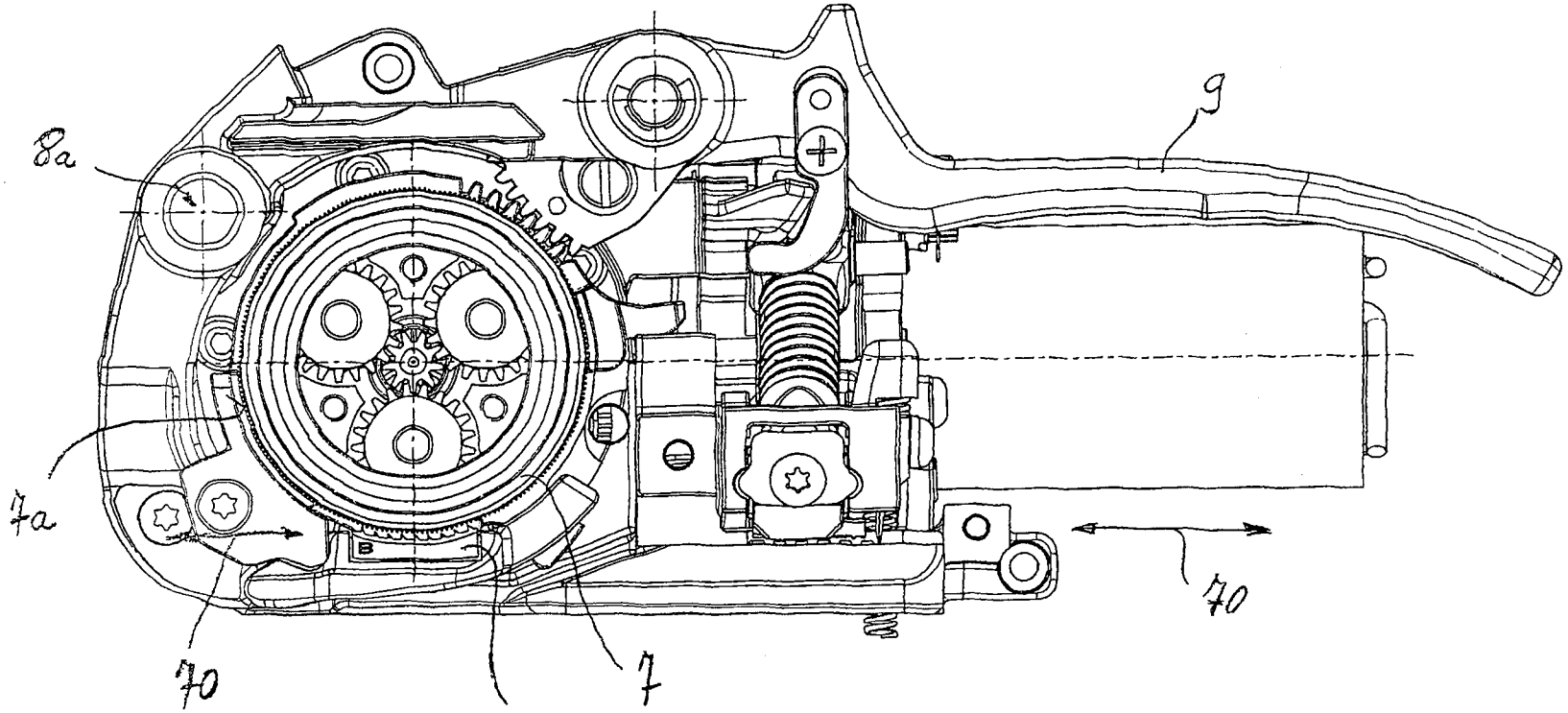
FIG. 11 shows a side view of the tensioner of the strapping device without the casing in which a tensioning rocker is in a tensioning position.

As has already been explained, the rocker 8 can through operating the rocker lever 9 shown in FIGS. 2, 10, 11 carry out pivoting movements about the rocker axis 8*a*. For this, the rocker is moved by a rotating cam disc which is behind the tensioning wheel 7 and cannot therefore be seen in FIG. 2. Via the rocker lever 9 the cam disc can carry out a rotational movement of approx. 30° and move the rocker 8 and/or the tensioning plate 12 relative to the tensioning wheel 7 which allow the strap to be inserted into the strapping device/between the tensioning wheel 7 and tensioning plate 12.

In this way, the toothed tensioning plate arranged on the free end of the rocker can be pivoted from a rest position shown in FIG. 10 into a tensioning position shown in FIG. 11 and back again. In the rest position the tensioning plate 12 is at sufficiently great distance from the tensioning wheel 7 that a wrapping strap can be placed in two layers between the tensioning wheel and the tensioning plate as required for producing connection on a strap loop. In the tensioning position the tensioning plate 12 is pressed in a known way, for example by means of a spring force acting on the rocker, against the tensioning wheel 7, whereby, contrary to what is shown in FIG. 11, in a strapping procedure the two-layer strap is located between the tensioning plate and the tensioning wheel and thus there should be no contact between the two latter elements. The toothed surface 12*a* (tensioning surface) facing the tensioning wheel 7 is concavely curved whereby the curvature radius corresponds with the radius of the tensioning wheel 7 or is slightly larger.

As can be seen in particular in FIGS. 10 and 11 as well as the detailed drawings of FIGS. 12-14, the toothed tensioning plate 12 is arranged in a grooved recess 71 of the rocker. The length—in relation to the direction of the strap—of the recess 71 is greater than the length of the tensioning plate 12. In addition, the tensioning plate 12 is provide with a convex contact surface 12*b* with which it is arranged on a flat contact surface 71 in the recess 71 of the rocker 8. As shown in particular in FIGS. 11 and 12 the convex curvature runs in a direction parallel to the strap direction 70, while the contact surface 12*b* is designed flat and perpendicular to this direction (FIG. 13). As a result of this design the tensioning plate 12 is able to carry out pivoting movements in the strap direction 70 relative to the rocker 8 and to the tensioning wheel 7. The tensioning plate 12 is also attached to the rocker 8 by means of a screw 72 passing through the rocker from below. This screw is in an elongated hole 74 of the rocker, the longitudinal extent of which runs parallel to the course of the strap 70 in the strapping device. As a result in addition to be pivotable, the tensioning plate 12 is also arranged on the rocker 8 in a longitudinally adjustable manner.

In a tensioner the tensioning rocker 8 is initially moved from the rest position (FIG. 10) into the tensioning position (FIG. 11). In the tensioning position the sprung rocker 8 presses the tensioning plate in the direction of the tensioning wheel and thereby clamps the two strap layers between the tensioning wheel 7 and the tensioning plate 12. Due to different strap thicknesses this can result in differing spacings between the tensioning plate 12 and circumferential surface 7*a* of the tensioning wheel 7. This not only results in different pivoting positions of the rocker 8, but also different positions of the tensioning plate 12 in relation to the circumferential direction of the tensioning wheel 7. In order to still achieve uniform pressing conditions, during the pressing procedure the tensioning plate 12 adjusts itself to the strap through a longitudinal movement in the recess 71 as well as a pivoting movement via the contact surface 12*b* on contact surface 72 so that the tensioning plate 12 exerts as even a pressures as possible over its entire length on the wrapping strap. If the tensioning wheel 7 is then switched on the toothing of tensioning plate 12 holds the lower strap layer fast, while the tensioning wheel 7 grasps the upper strap layer with its toothed circumferential surface 7*a*. The rotational movement of the tensioning wheel 7 as well the lower coefficient of friction between the two strap layers then results in the tensioning wheel pulling back the upper band layer, thereby increasing the tension in the strap loop up to the required tensile force value.

LIST OF REFERENCES

1. Strapping device 1
2. Casing
3. Grip
4. Base plate
6. Tensioner
7. Tensioning wheel
7*a*. Circumferential surface
8. Rocker
8. Rocker pivoting axis
9. Rocker lever
10. Friction welder
11. Welding shoe
12. Tensioning plate
12*a*. Tensioning surface
12*b*. Contact surface
13. Gear system device
14. Electric direct current motor
15. Storage battery
16. Operating element
17. Switch
18. Operating element
19. Transmission device
20. Rotor
HS1 Hall sensor
HS2 Hall sensor
HS3 Hall sensor
22. Electronic control
24. Stator
25. Bridging circuit
27. Motor side output shaft

28. Sun gear
30. Shaft
31. Cog wheel
32. Cam
32*a*. Surface
33. Cam wheel
35. Sun gear
36. Free wheel
37. Planetary gear
38. Socket
39. Shaft
40. Output gear
42. Free wheel
43. Bevel gear
46. Planetary gear system
47. Sun gear
48. Planetary gear
49. Tensioning wheel
50. Toothed belt
51. Pinion
52. Eccentric drive
53. Welding shoe
54. Eccentric shaft
55. Eccentric tappet
56. Welding shoe arm
57. Rotational axis eccentric shaft
60. Toggle lever device
61. Longer toggle lever
62. Pivoting axis
63. Pivoting element
64. Contact element
65. Pivoting axis
66. Pivoting axis
67. Pressure spring
68. Connecting line
69. Pivoting axis
70. Strap direction
71. Recess
72. Contact surface
73. Screw
74. Elongated hole

The invention claimed is:

1. A mobile strapping device for strapping packaged goods with a wrapping strap, comprising a tensioner for applying a strap tension to a loop of wrapping strap, as well as a friction welder for producing a friction weld connection by way of reciprocating movement of a friction welding element at two areas of the loop of wrapping strap disposed one on top of the other, and a chargeable energy storage means for storing electrical energy which can be released as drive energy for motorized drive motions provided by an electrical drive of the friction welder at least for the friction welder for producing the friction weld connection, characterized by a planetary gear system for transferring and changing rotational speed for the motorized drive motions provided by the electrical drive of the friction welder at least for the reciprocating movement of the friction welding element of the friction welder for producing the friction weld connection.

2. The mobile strapping device in accordance with claim 1 characterized in that the electrical drive is designed as a brushless direct current motor.

3. The mobile strapping device in accordance with claim 1 characterized by automatic switching off of the electrical drive.

4. The mobile strapping device in accordance with claim 3 characterized by means for determining a rotational position of a motor shaft of the electrical drive or a position of an element arranged in a drive train of the friction welder dependent on the rotational position of the motor shaft.

5. The mobile strapping device in accordance with claim 4 characterized by at least one detector arranged on the electrical drive for determining the rotational position of the motor shaft.

6. The mobile strapping device in accordance with claim 5, characterized by the at least one detector also being part of a circuit for controlling an electronically generated commutation of the electrical drive.

7. The mobile strapping device in accordance with claim 1, wherein a duration of a welding cycle, during which the friction welder is in use, can be adjusted, whereby the duration can be predetermined depending on a number of revolutions of the electrical drive.

8. The mobile strapping device in accordance with claim 1, characterized by means for moving the friction welder from a rest position into a welding position, whereby the means can be driven with the same electrical drive with which an oscillating movement of the friction welder used for producing the friction weld can be generated.

9. The mobile strapping device in accordance with claim 1, wherein the friction welder is provided with a toggle lever, which can be pivoted between two end positions, whereby one end position of the toggle lever determines a friction welding position and the other end position of the toggle lever is a rest position in which the friction welder is not in use.

10. The mobile strapping device in accordance with claim 9, characterized in that the toggle lever is articulated in a pivoting manner about two pivoting axes, whereby at least movement in one direction between the two end positions takes place as a motor-driven movement by the electrical drive of the strapping device.

11. The mobile strapping device in accordance with claim 9 characterized by the planetary gear system which to move the toggle lever from the rest position into the friction welding position transfers the motorized drive motions of the electrical drive to the tensioner.

12. The mobile strapping device in accordance with claim 9, wherein the toggle lever is sprung.

13. The mobile strapping device in accordance with claim 1, characterized by only one common electrical drive of the tensioner and the friction welder.

14. The mobile strapping device in accordance with claim 13 characterized in that the common electrical drive is rotatable in a first direction to drive only the tensioner and in a second different direction to drive only the friction welder.

15. The mobile strapping device in accordance with claim 1, characterized by a rotational speed-controlled tensioning cycle of the tensioner, during which the electrical drive is at least at times operated at different rotational speeds at an essentially constant torque.

16. The mobile strapping device in accordance with claim 1, characterized by operating means for starting an automatic friction welding procedure in which the friction welder is moved by the motorized drive motions into a friction welding position and the friction weld connection is produced by the friction welding element.

17. The mobile strapping device in accordance with claim 1, characterized by operating means for joint operation of the tensioner and the friction welder by means of which the tensioner and the friction welder can be started up consecutively.

18. The mobile strapping device in accordance with claim 1, wherein a motor-side output shaft with several functional components can be functionally connected to the strapping device, whereby one of the functional components is the friction welder, upstream of which the planetary gear system is connected.

19. The mobile strapping device in accordance with claim 1, characterized by two planetary gear systems for transferring and changing the rotational speed for the motorized drive motions provided by the electrical drive of the friction welder.

20. An apparatus, comprising:

a mobile strapping device configured for strapping packaged goods with a wrapping strap, the device including:

a electrical drive motor;

a tensioner assembly configured to apply a strap tension to a loop of wrapping strap;

a friction welder configured to produce a friction weld connection by way of reciprocating movement of a friction welding element at two areas of the loop of wrapping strap disposed one on top of the other; and a chargeable battery configured to store electrical energy, wherein the device is configured such that stored electrical energy in the chargeable battery is controllably released as drive energy for motorized drive motions provided by the electrical drive motor at least for the friction welder for producing the friction weld connection, and wherein the device further includes a planetary gear system configured to transfer and change rotational speed for the motorized drive motions provided by the electrical drive motor at least for the reciprocating movement of the friction welding element of the friction welder for producing the friction weld connection.

21. The apparatus in accordance with claim 20, wherein the mobile strapping device is configured such that a rotational force from the electrical drive motor imparts a force on a toggle lever device, thereby producing a transfer movement of the friction welder that drives the friction welder from a rest position into a welding position.

22. The apparatus in accordance with claim 20, wherein the mobile strapping device is configured such that a rotational force from the electrical drive motor imparts a moment onto a component, thereby rotating the component, wherein the component is linked to the friction welder such that the rotation of the component drives the friction welder from a rest position into a welding position.

23. The apparatus in accordance with claim 20, wherein the mobile strapping device is configured such that a rotational force from the electrical drive motor imparts a force onto a first arm of a toggle lever device, which is linked to a second arm of the toggle lever device, which in turn is coupled to the friction welder, such that the first arm moves from a first position, owing to the imparted force onto the first arm, where the friction welder is at a rest position towards a second position where the friction welder is at a welding position, the movement from the first position towards the second position driving the friction welder from the rest position towards the welding position.

24. The apparatus in accordance with claim 20, wherein the mobile strapping device is configured such that the electrical drive motor imparts force onto a device such that the force is mechanically communicated from the electrical drive motor to the friction welder.

25. The apparatus in accordance with claim 20, wherein the mobile strapping device includes a toggle lever device that transfers force from the electrical drive motor to the friction welder, thereby producing a transfer movement of the friction welder by moving the toggle lever device.

26. The apparatus in accordance with claim 20, wherein the mobile strapping device includes a toggle lever device that transfers force from the electrical drive motor to the friction welder, thereby producing a transfer movement of the friction welder by moving the toggle lever device from a position where arms of the toggle lever device are inflected towards a position where the arms of the toggle lever device are parallel.

27. The apparatus in accordance with claim 20, wherein the mobile strapping device includes a toggle lever device, wherein the mobile strapping device is configured such that force from the electrical drive motor is transferred to a first arm of the toggle lever device, thereby imparting movement in one of a clockwise direction and a counterclockwise direction, and such that the movement of the first arm causes a second arm of the toggle lever device connected to the first arm to move in the other of the clockwise direction and the counterclockwise direction, which movement of the second arm produces a transfer movement of the friction welder.

28. The apparatus in accordance with claim 20, wherein the apparatus is configured such that the electrical drive motor drives the tensioner assembly and the friction welder.

29. The apparatus of claim 20, wherein the apparatus is configured such that upon the controlled release of the stored electrical energy from the chargeable battery to the electrical drive motor, the motorized drive motions are generated by the electrical drive motor.

30. The apparatus of claim 20, wherein the apparatus is configured such that upon stopping the release of the stored electrical energy from the chargeable battery to the electrical drive motor, the motorized drive motions generated by the electrical drive motor are stopped.

31. The apparatus of claim 20 wherein the electrical drive motor is configured to alternately rotate in a first direction and a second direction that is the opposite of the first direction, and wherein the electrical drive motor only drives the tensioner when rotating in the first direction and only drives the friction welder when rotating in the second direction.

32. The apparatus of claim 20, wherein the mobile strapping device is configured such that when a rotational force from the electrical drive motor imparts a force onto a first arm of a toggle lever device, which is linked to a second arm of the toggle lever device, the first arm moves from a first position in which the friction welder is at a rest position towards a second position in which the friction welder is at a welding position, the movement of the first arm from the first position towards the second position driving the friction welder from the rest position towards the welding position.

33. A mobile strapping device for strapping packaged goods with a wrapping strap, comprising a tensioner for applying a strap tension to a loop of wrapping strap, as well as a friction welder for producing a friction weld connection by way of a friction welding element at two areas of the loop of wrapping strap disposed one on top of the other, and a chargeable energy storage means for storing electrical energy which can be released as drive energy for motorized drive motions provided by only one common electrical drive of the tensioner and the friction welder at least for the friction welder for producing the friction weld connection, characterized by a planetary gear system for transferring and changing rotational speed for the motorized drive motions provided by the electrical drive of the friction welder at least for the friction welder for producing the friction weld connection, and characterized in that the common electrical drive is rotatable in a first direction to drive only the tensioner and a second different direction to drive only the friction welder.

34. An apparatus, comprising:

a mobile strapping device configured for strapping packaged goods with a wrapping strap, the device including:

a electrical drive motor;

a tensioner assembly configured to apply a strap tension to a loop of wrapping strap;

a friction welder configured to produce a friction weld connection by way of a friction welding element at two areas of the loop of wrapping strap disposed one on top of the other; and a chargeable battery configured to store electrical energy, wherein the device is configured such that stored electrical energy in the chargeable battery is controllably released as drive energy for motorized drive motions provided by the electrical drive motor at least for the friction welder for producing the friction weld connection, wherein the device further includes a planetary gear system configured to transfer and change rotational speed for the motorized drive motions provided by the electrical drive motor at least for the friction welder for producing the friction weld connection, and wherein the electrical drive motor is configured to alternately rotate in a first direction and a second direction that is the opposite of the first direction, and wherein the electrical drive motor only drives the tensioner when rotating in the first direction and only drives the friction welder when rotating in the second direction.

* * * * *